US009587916B2

(12) United States Patent
Burtan

(10) Patent No.: US 9,587,916 B2
(45) **Date of Patent: *Mar. 7, 2017**

(54) MECHANISM FOR RAISING AND LOWERING A WEAPONRY TARGET

(71) Applicant: Birchwood Limited, Prescott, AZ (US)

(72) Inventor: Blair Medford Burtan, Prescott, AZ (US)

(73) Assignee: BIRCHWOOD LIMITED, Prescott, AZ (US)

( * ) Notice: Subject to any disclaimer, the term of this patent is extended or adjusted under 35 U.S.C. 154(b) by 64 days.

This patent is subject to a terminal disclaimer.

(21) Appl. No.: 14/748,132

(22) Filed: Jun. 23, 2015

(65) Prior Publication Data

US 2015/0292843 A1 Oct. 15, 2015

Related U.S. Application Data

(63) Continuation-in-part of application No. 13/603,672, filed on Sep. 5, 2012, now Pat. No. 9,097,498.

(51) Int. Cl.

| | |
|---|---|
| ***F41J 1/10*** | (2006.01) |
| ***F41J 7/02*** | (2006.01) |
| ***F41J 11/02*** | (2009.01) |
| ***F41J 7/04*** | (2006.01) |
| ***F41J 7/06*** | (2006.01) |

(52) U.S. Cl.

CPC . *F41J 1/10* (2013.01); *F41J 7/04* (2013.01); *F41J 7/06* (2013.01)

(58) Field of Classification Search

CPC ..... F41J 1/10; F41J 7/04

USPC ..... 273/406, 407, 391

See application file for complete search history.

(56) References Cited

U.S. PATENT DOCUMENTS

| | | | | |
|---|---|---|---|---|
| 4,190,280 A * | 2/1980 | Donohoe | A61G 1/0212 | 280/32.7 |
| 4,934,937 A * | 6/1990 | Judd | F41G 3/2655 | 273/371 |
| 5,222,741 A * | 6/1993 | Redl | F41J 7/04 | 273/393 |
| 5,598,591 A * | 2/1997 | Kelley | A47C 17/80 | 254/122 |
| 5,603,505 A * | 2/1997 | Acock | F41J 7/06 | 273/391 |

(Continued)

*Primary Examiner* — Gene Kim
*Assistant Examiner* — M Chambers
(74) *Attorney, Agent, or Firm* — Bennet K. Langlotz; Langlotz Patent & Trademark Works, Inc.

(57) ABSTRACT

A weaponry target mechanism has a base, an arm pivotally connected to the base to pivot about a lower arm axis, a platform pivotally connected to the arm to pivot about a target axis, an elongated target attached to the platform, a drive mechanism connected to the base at a first connection location and the platform at a second connection location, wherein the platform is movable with respect to the base such that the target assumes an upright position in which the target is in a first pivotal orientation and a dropped position in which the target is in a second pivotal orientation pivotally offset from the first pivotal orientation; and wherein the platform is rotationally moveable with respect to the base such that the platform is parallel to the base in the upright position and the platform is not parallel to the base in the dropped position.

8 Claims, 21 Drawing Sheets

(56) References Cited

U.S. PATENT DOCUMENTS

| | | | | | |
|---|---|---|---|---|---|
| 5,720,059 | A * | 2/1998 | Allevato | A61G 7/012 | 5/610 |
| 5,816,579 | A * | 10/1998 | Broussard | F41J 1/01 | 273/407 |
| 6,851,144 | B2 * | 2/2005 | Wang | A61G 7/015 | 5/109 |
| 7,654,208 | B2 * | 2/2010 | Patten | A47B 46/005 | 108/138 |
| 9,097,498 | B2 * | 8/2015 | Burtan | F41J 7/04 | |
| 2003/0071472 | A1 * | 4/2003 | Henderson | A61G 1/06 | 296/20 |
| 2014/0062023 | A1 * | 3/2014 | Burtan | F41J 7/04 | 273/407 |
| 2015/0292843 | A1 * | 10/2015 | Burtan | F41J 1/10 | 273/391 |

* cited by examiner

MECHANISM FOR RAISING AND LOWERING A WEAPONRY TARGET

CROSS-REFERENCE TO RELATED APPLICATION

This is a Continuation-in-Part of U.S. patent application Ser. No. 13/603,672 filed on Sep. 5, 2012, entitled "MECHANISM FOR RAISING AND LOWERING A WEAPONRY TARGET."

FIELD OF THE INVENTION

The present invention relates to weaponry targets, and more particularly to a weaponry target mechanism that maintains the target's center of mass over the mechanism even in the dropped position.

BACKGROUND OF THE INVENTION

Automated weaponry targets have long been known and widely used at civilian, law enforcement, and military shooting ranges. Although such devices have achieved considerable popular and commercial success, there is much room for improvement. Existing systems present the target mannequin in a fully vertical (standing) position. After the target mannequin is hit, the mannequin drops to a fully horizontal position to indicate a kill. These existing systems require considerable physical space to permit the mannequin to drop. Furthermore, the center of mass of such systems shifts dramatically between the upright and dropped positions. The change in the position of the center of mass interferes with use of such systems on moving platforms. Finally, the devices offer no control over the speed or intermediate position of the target mannequin as the mannequin drops.

Although these designs are effective for their intended purpose, they are limited to use where considerable space is available and where the target is mounted on a stationary platform.

Therefore, a need exists for a new and improved weaponry target mechanism that maintains the target's center of mass over a mechanism even in the dropped position. In this regard, the various embodiments of the present invention substantially fulfill at least some of these needs. In this respect, the weaponry target mechanism according to the present invention substantially departs from the conventional concepts and designs of the prior art, and in doing so provides an apparatus primarily developed for the purpose of maintaining the target's center of mass over the mechanism even in the dropped position.

SUMMARY OF THE INVENTION

The present invention provides an improved weaponry target mechanism, and overcomes the above-mentioned disadvantages and drawbacks of the prior art. As such, the general purpose of the present invention, which will be described subsequently in greater detail, is to provide an improved weaponry target mechanism that has all the advantages of the prior art mentioned above.

To attain this, the preferred embodiment of the present invention essentially comprises a base, an arm pivotally connected to the base to pivot about a lower arm axis, a platform pivotally connected to the arm to pivot about a target axis, an elongated target attached to the platform, a drive mechanism connected to the base at a first connection location spaced apart from the lower arm axis, the drive mechanism connected to the platform at a second connection location spaced apart from the target axis, wherein the platform is movable with respect to the base such that the target assumes an upright position in which the target is in a first pivotal orientation and a dropped position in which the target is in a second pivotal orientation pivotally offset from the first pivotal orientation; and wherein the platform is rotationally moveable with respect to the base such that the platform is parallel to the base in the upright position and the platform is not parallel to the base in the dropped position.

There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
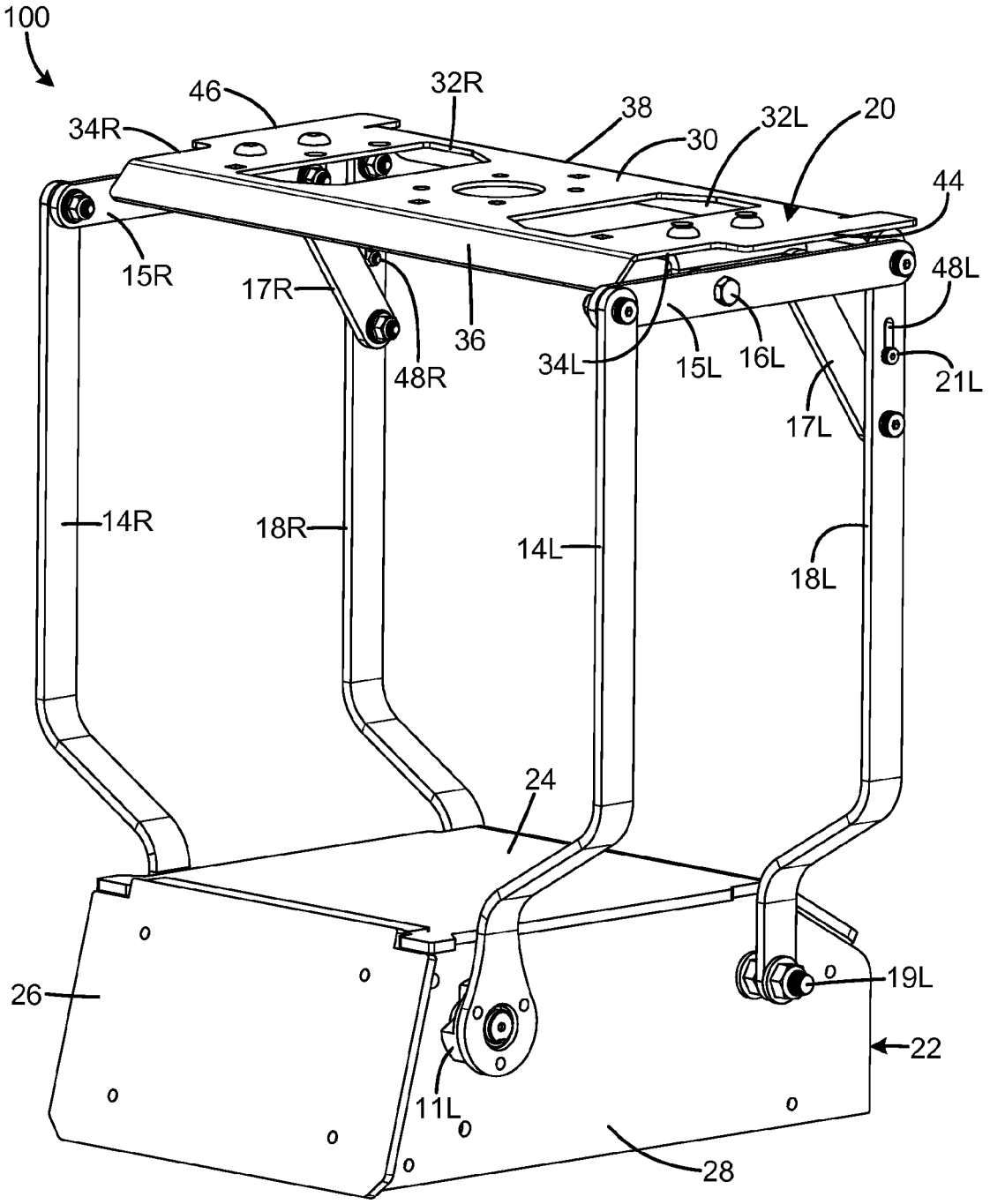
FIG. 1 is a top perspective view of the current embodiment of a weaponry target mechanism constructed in accordance with the principles of the present invention in the upright position.

An embodiment of the weaponry target mechanism of the present invention is shown and generally designated by the reference numeral 100.

FIG. 1 illustrates the improved weaponry target mechanism 100 of the present invention. More particularly, the mechanism is shown without a target mannequin attached. The mechanism is depicted in the upright position.

The upper portion of the mechanism 100 has a generally rectangular target mounting plate or platform 20 with a front 36, rear 38, left 44, right 46, top 30, and bottom 40. The front of the left and right sides of the mounting plate define recesses 34R, 34L. The front and rear of the mounting plate are bent downward at about a 45° angle. A number of mounting features are present on the mounting plate to permit releasable attachment of a target mannequin. These include leg holes 32R, 32L and a central aperture 48. The bottom has two mounting brackets 46R, 46L attached to the left and right sides (shown in FIG. 5). The bottom rear of the mounting plate rests on the upper end of the rear support arms 18R, 18L when the mechanism is in the upright position.

The front portion of the mounting brackets 46R, 46L is pivotally connected to a middle portion of upper pivot supports 15R, 15L by pivot shafts 16R, 16L so that the mounting plate 20 can rotate freely. The rear end of the upper pivot supports is pivotally connected to the upper end of the rear support arms 18R, 18L by pivot shafts. The front end of the upper pivot supports is pivotally attached to one end of main pivot arms 14R, 14L.

The rear portion of the mounting brackets 46R, 46L is pivotally connected to the upper end of tilt linkage arms 17R, 17L by pivot shafts. The lower end of the tilt linkage arms is pivotally connected to a middle portion of the rear support arms 18R, 18L by pivot shafts. The lower end of the main pivot arms 14R, 14L is connected to hubs 11R, 11L. The lower end of the rear support arms is pivotally attached to rear pivots 19R, 19L.

The rear support arms 18R, 18L each define a slot 48R, 48L located between the attachment points of the tilt linkage arms 17R, 17L and the upper pivot supports 15R, 15L. Each slot receives a motion stop 21R, 21L.

The hubs 11R, 11L and pivots 19R, 19L protrude from the left cover 28 and right cover 44 (shown in FIG. 5) of housing 22. The housing 22 also has a top cover 24, a front cover 26, and a rear cover 42. The housing serves as a base for the mechanism 100. The combination of a main pivot arm, upper pivot support, rear support arm, and the housing forms a four-sided polygon with a pivot point at each corner on either side of the mounting plate 20.

Figure 2:
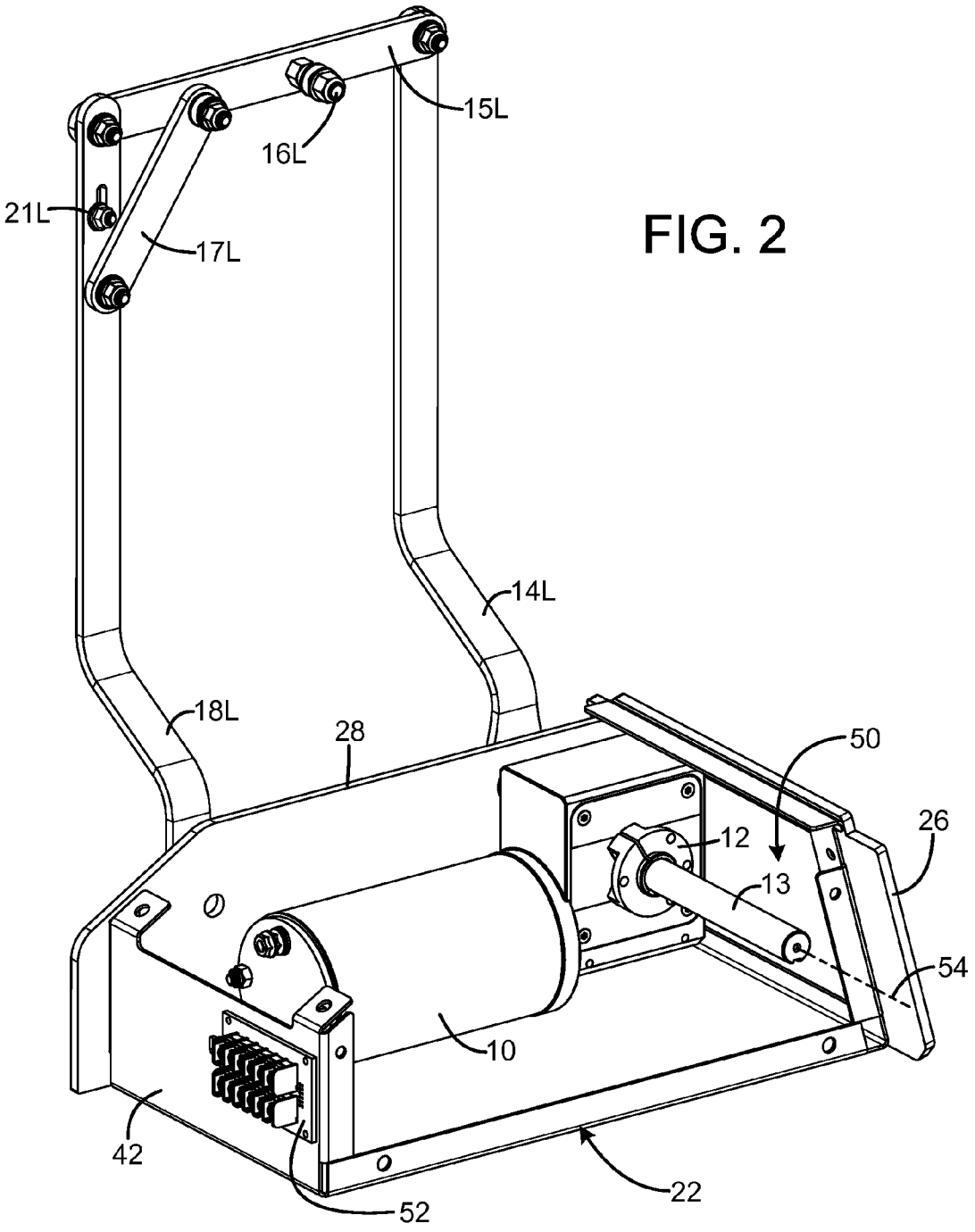
FIG. 2 is a top perspective view of the weaponry target mechanism of FIG. 1 with various components removed to expose the interior of the housing.

FIG. 2 illustrates the improved weaponry target mechanism 100 of the present invention. More particularly, the mechanism is shown with the top cover 24 and the right cover 44 and associated parts removed to expose the interior 50 of the housing 22.

The interior 50 of the housing 22 receives an actuator 10 that drives a shaft 13. A position feedback sensor 12 mounted on the shaft provides accurate position information to control electronics 52 mounted on the rear cover 42. The shaft 13 is connected to the hubs 11R, 11L.

Figure 3:
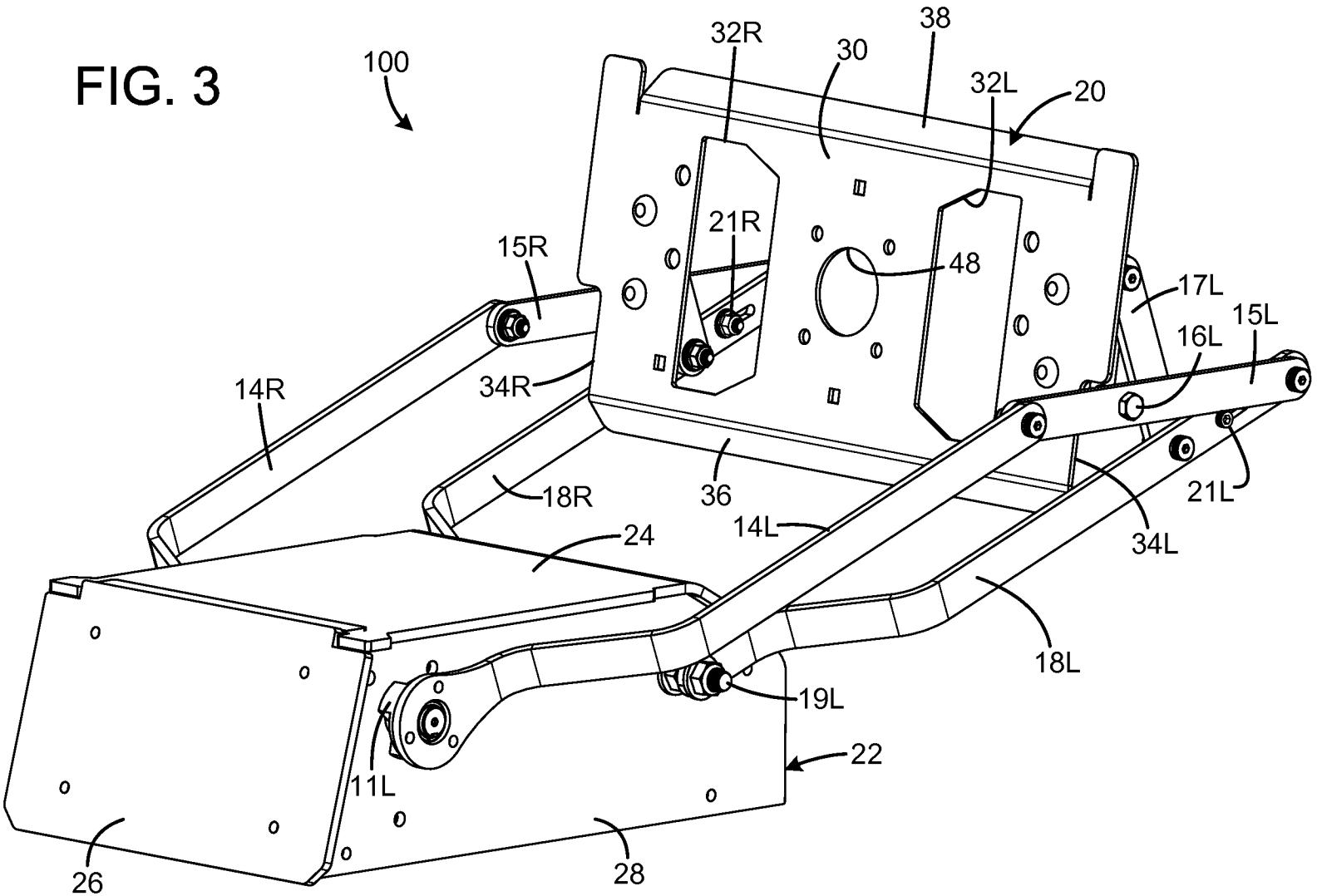
FIG. 3 is a top perspective view of the weaponry target mechanism of FIG. 1 in the dropped position.
Figure 4:
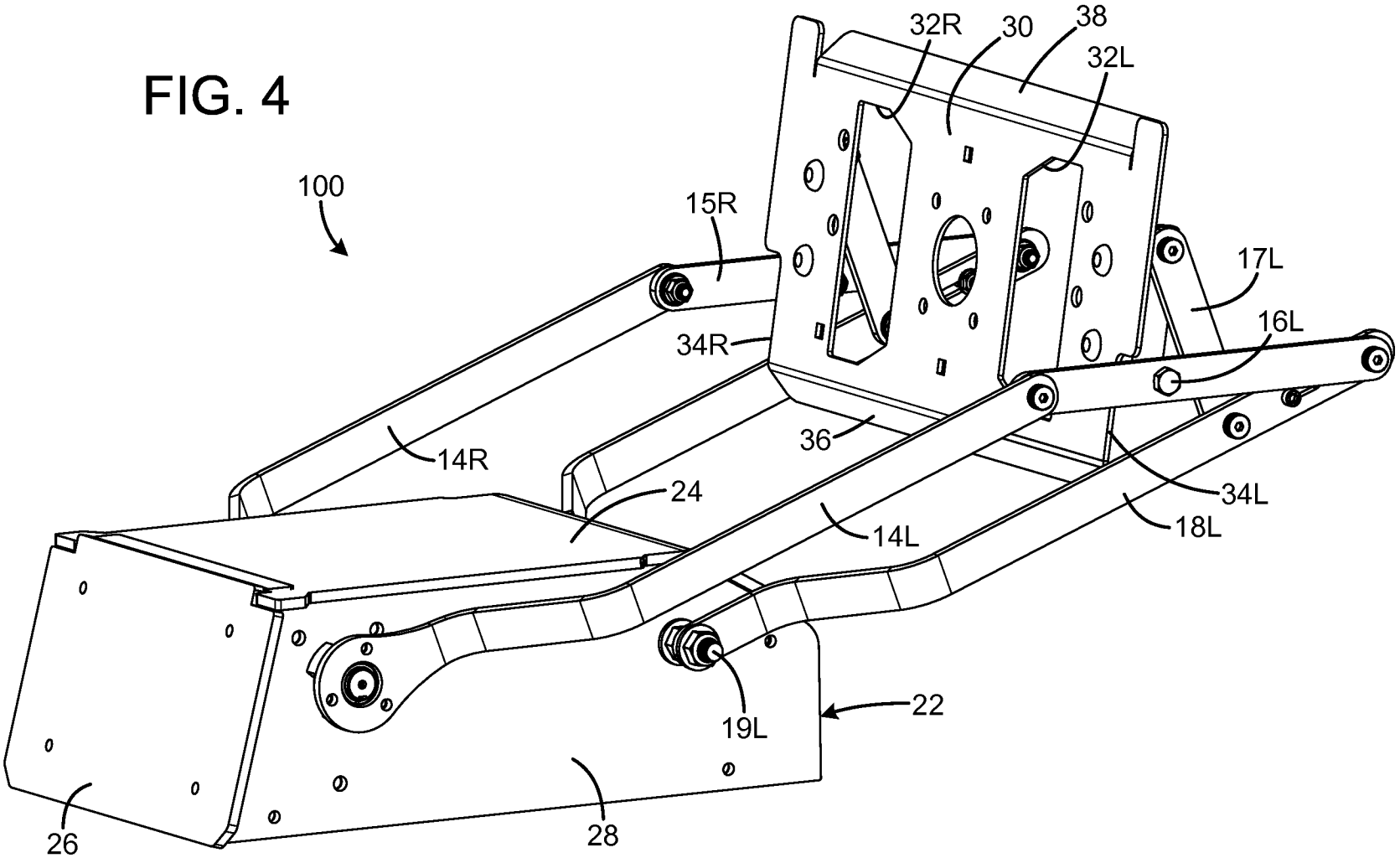
FIG. 4 is a top perspective view of the weaponry target mechanism of FIG. 3 rotated clockwise.
Figure 5:
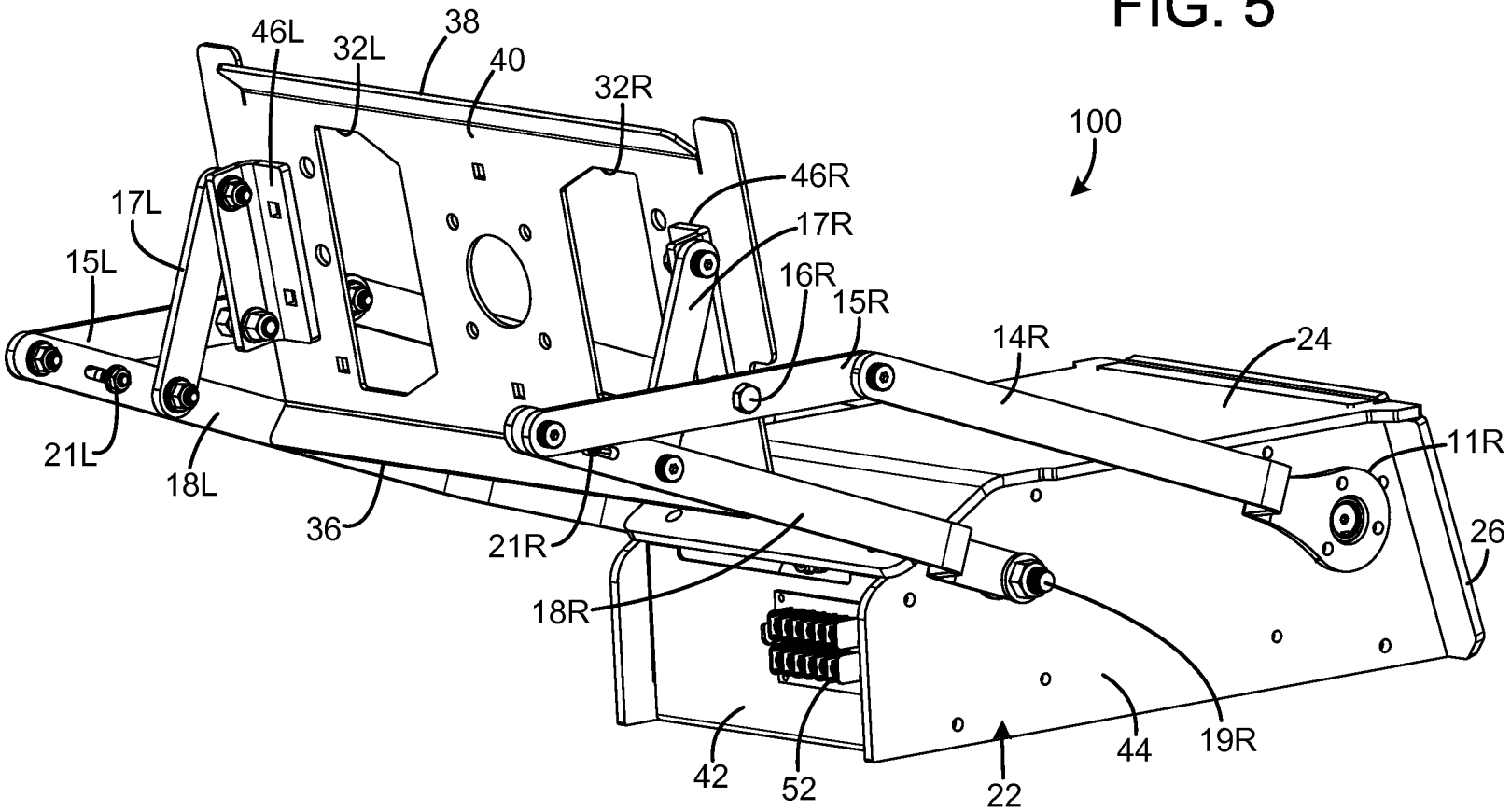
FIG. 5 is a rear perspective view of FIG. 3 in the dropped position.

FIGS. 3-5 illustrate the improved weaponry target mechanism 100 of the present invention. More particularly, the mechanism is shown in the dropped position. Since the hubs 11R, 11L connected to the lower end of the main pivot arms 14R, 14L, rotational motion of the shaft causes the main pivot arms to rotate about the shaft's longitudinal axis 54. This rotation induces rotation of the rear support arms 18R, 18L about the rear pivots 19R, 19L because of the connections between the main pivot arms, upper support pivots 15R, 15L, and rear support arms.

As the angle between the upper pivot supports 15R, 15L and the rear support arms 18R, 18L changes, the tilt linkage arms 17R, 17L cause the target mounting plate 20 to rotate about pivot shafts 16R, 16L in a direction opposite that of the main pivot arms 14R, 14L. The motion stops 21R, 21L prevent the rear support arms from rotating more than a desired amount. The recesses 34R, 34L on either side of the mounting plate 20 provide clearance for the upper support pivots 15R, 15L.

Figure 6:
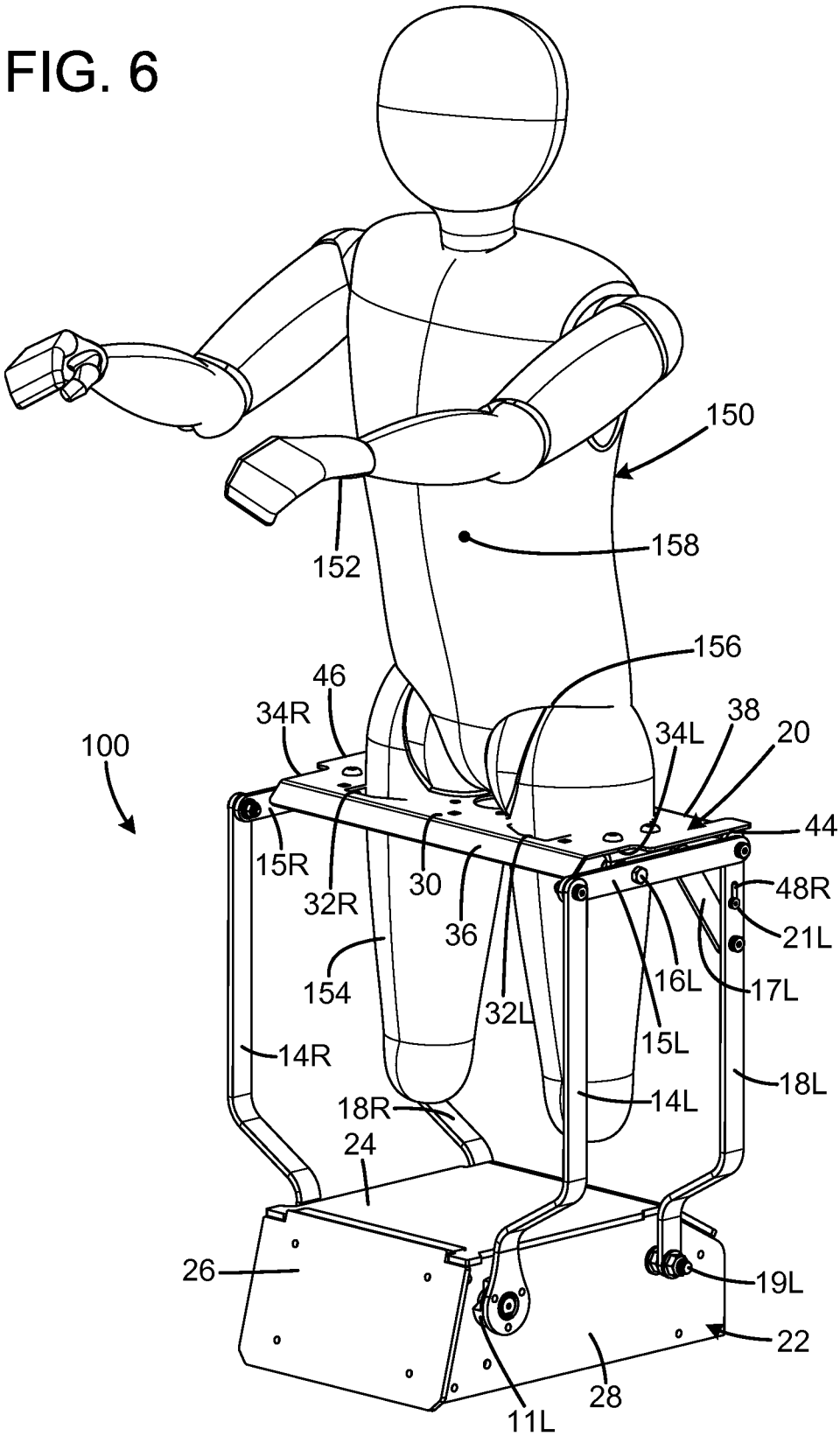
FIG. 6 is a top perspective view of the weaponry target mechanism of the present invention in the upright position with an attached mannequin having arms and legs.
Figure 7:
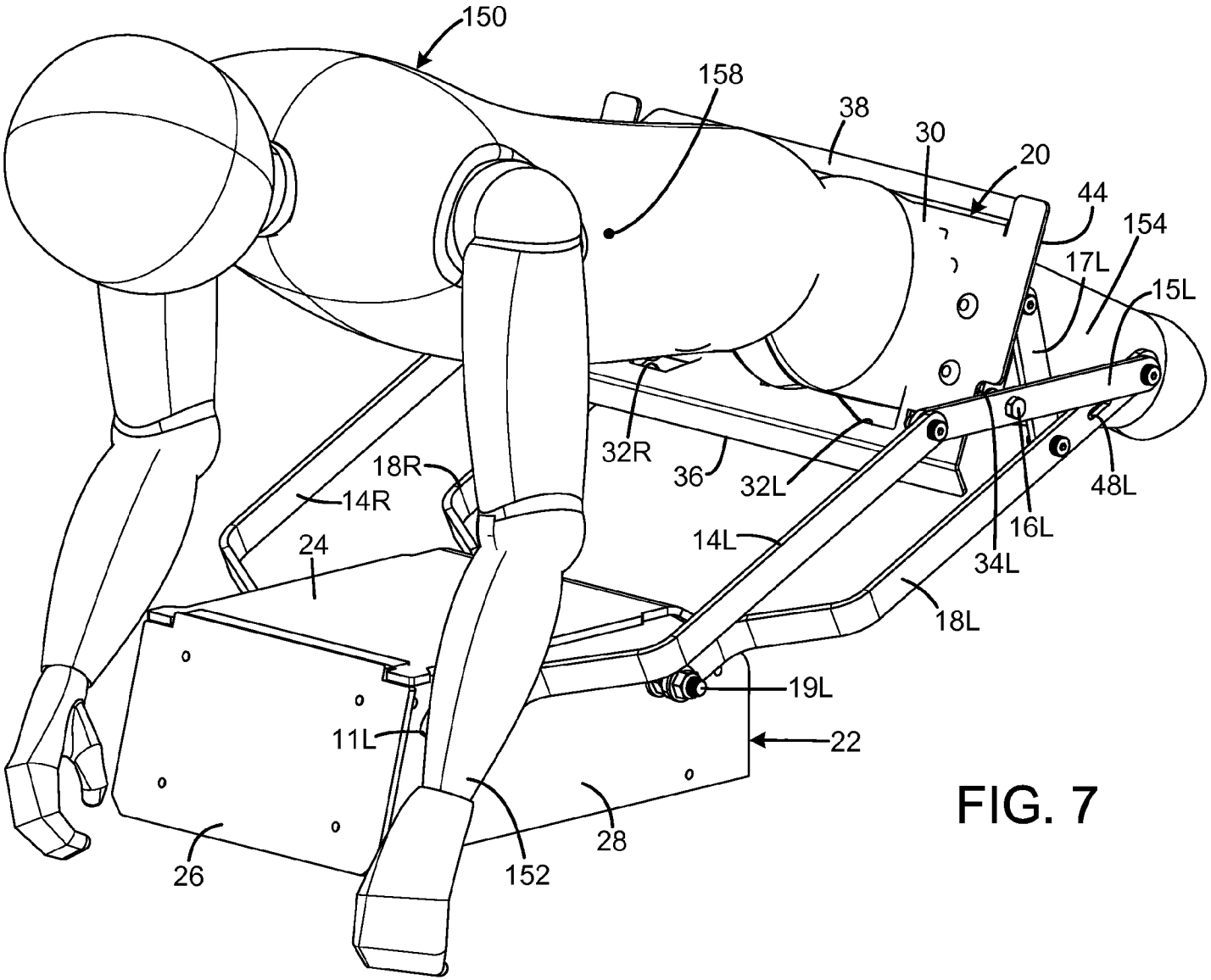
FIG. 7 is a top perspective view of FIG. 6 in the dropped position.

FIGS. 6-7 illustrate the improved weaponry target mechanism 100 of the present invention. More particularly, the mechanism is shown with a target mannequin 150 attached to the target mounting plate 20 at the approximate location of the mannequin's waistline 156. FIG. 6 shows the mannequin in the standing or "alive" condition. FIG. 7 shows the mannequin attached to the target mounting plate in the collapsed or "killed" position. The mannequin has arms 152, legs 154, and a center of mass 158. The legs of the mannequin are inserted through leg holes 32R, 32L in the mounting plate 20 to releasably secure the mannequin to the mechanism.

Figure 8:
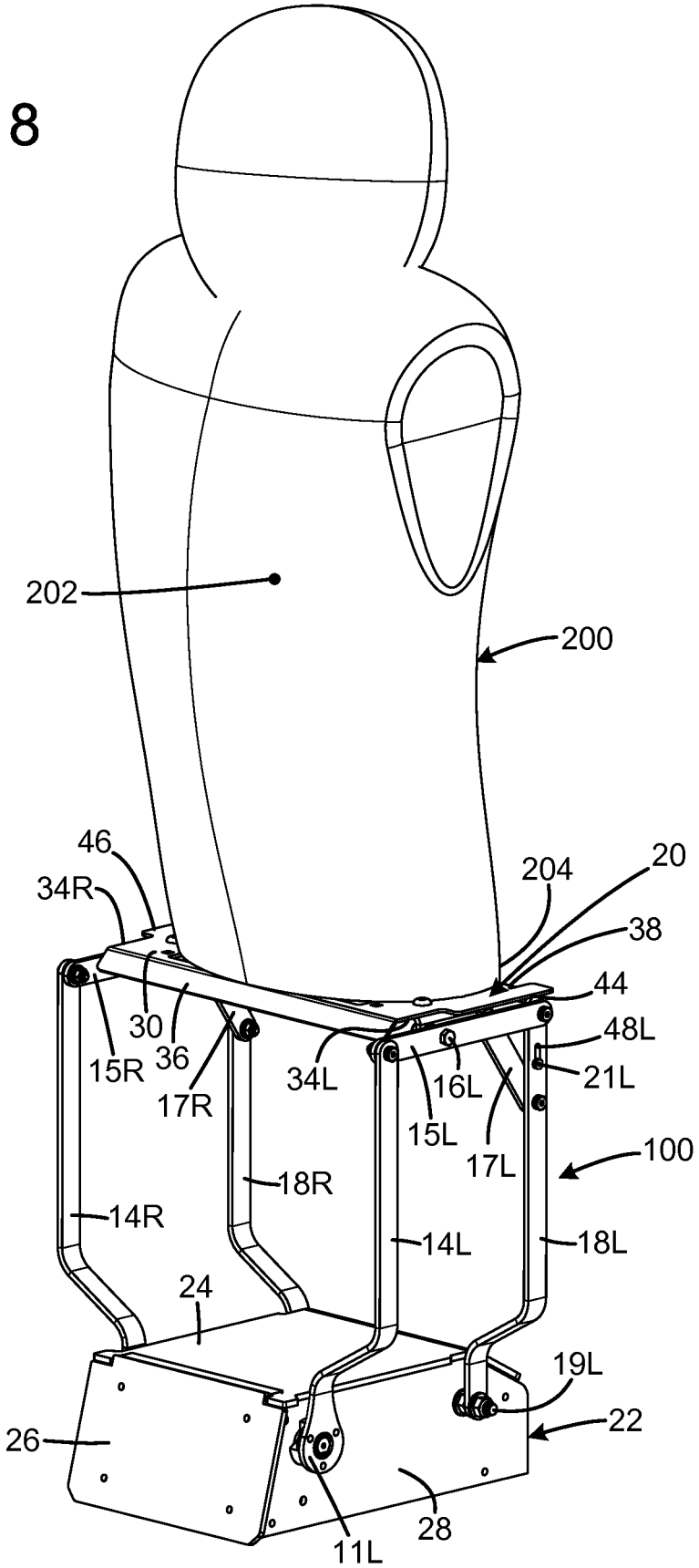
FIG. 8 is a top perspective view of the target mount of the present invention in the upright position with an attached standard military-style mannequin.
Figure 9:
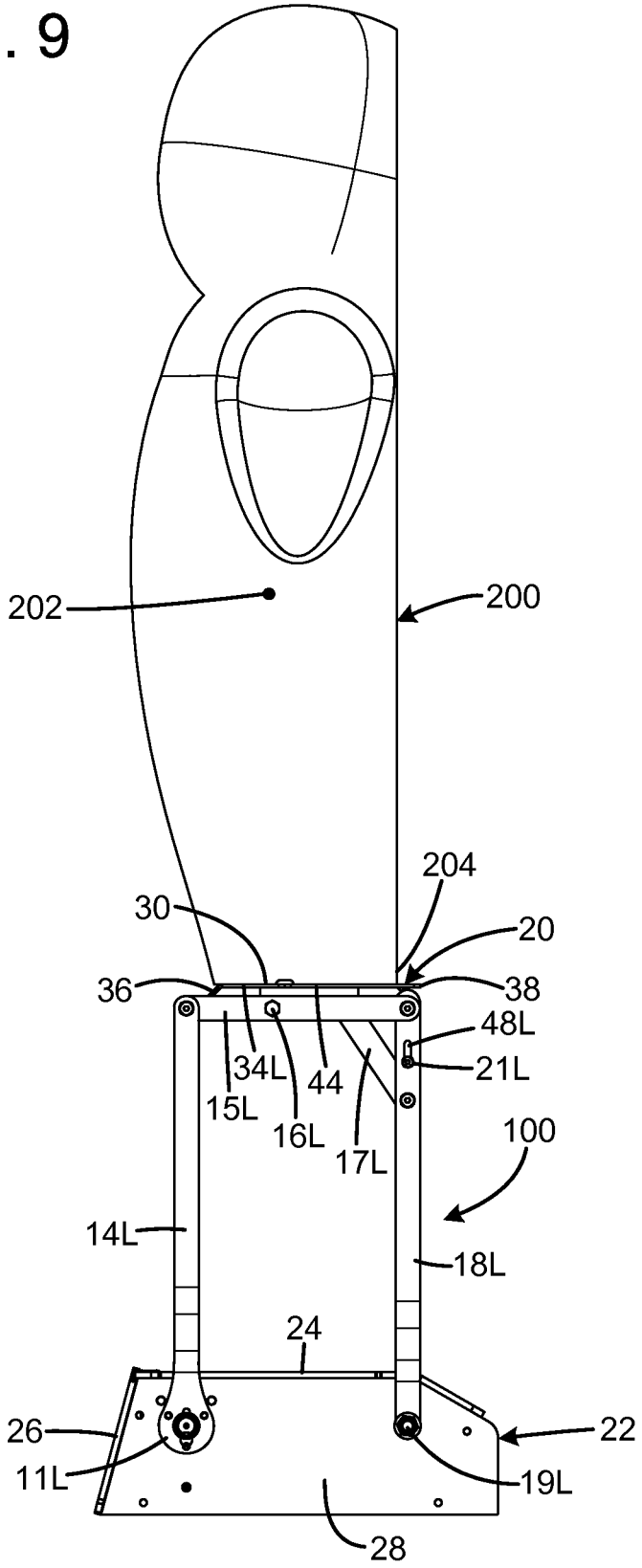
FIG. 9 is a side view of FIG. 8 in the upright position.
Figure 10:
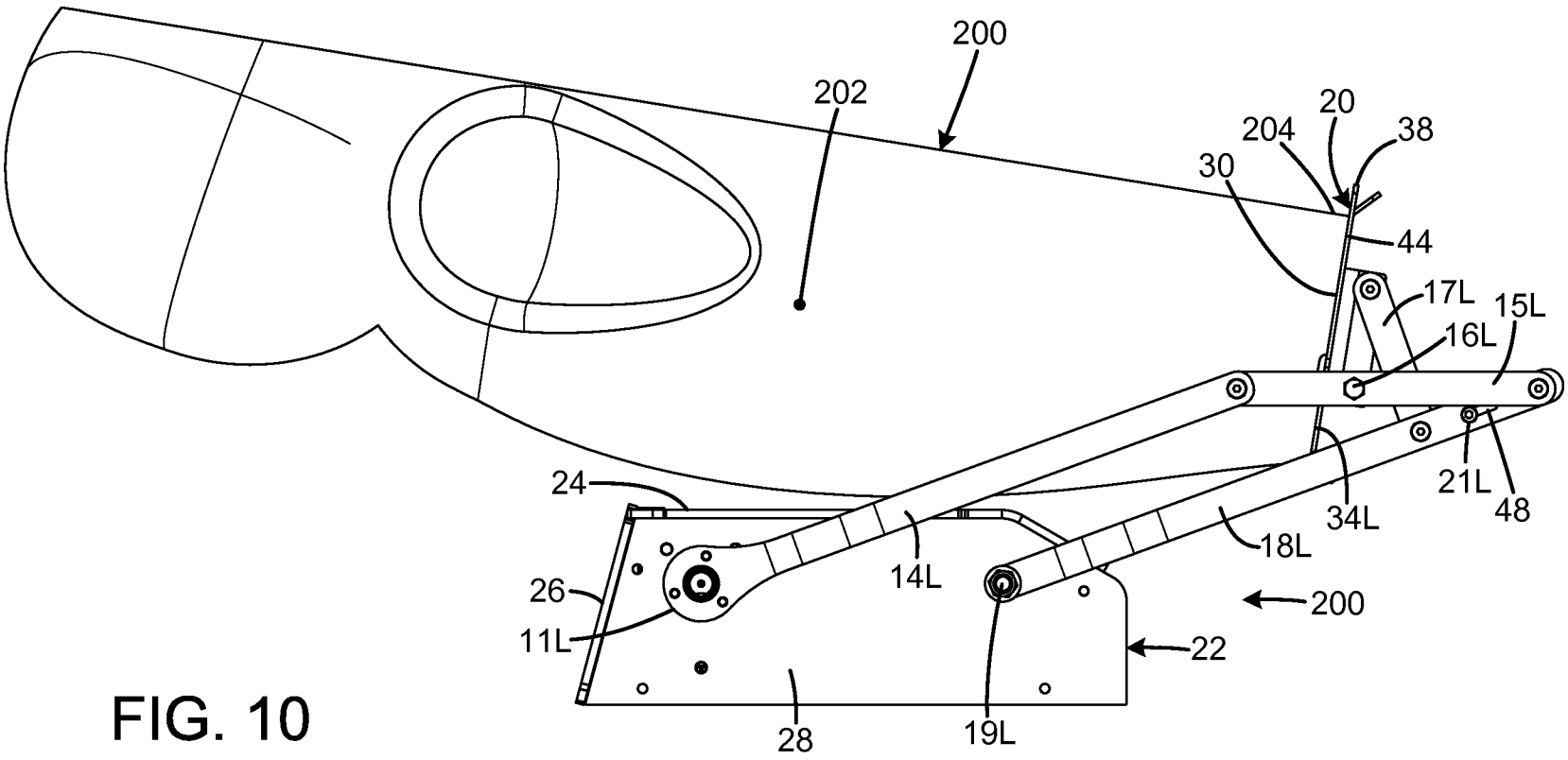
FIG. 10 is a top perspective view of FIG. 8 in the dropped position.

FIGS. 8-10 illustrate the improved weaponry target mechanism 100 of the present invention. More particularly, the mechanism is shown with a target mannequin 200 attached to the target mounting plate 20 at the approximate location of the mannequin's waistline 204. FIGS. 8-9 show the mannequin in the standing or "alive" condition. FIG. 10 shows the mannequin attached to the target mounting plate in the collapsed or "killed" position. The mannequin has a center of mass 202.

Figure 11:
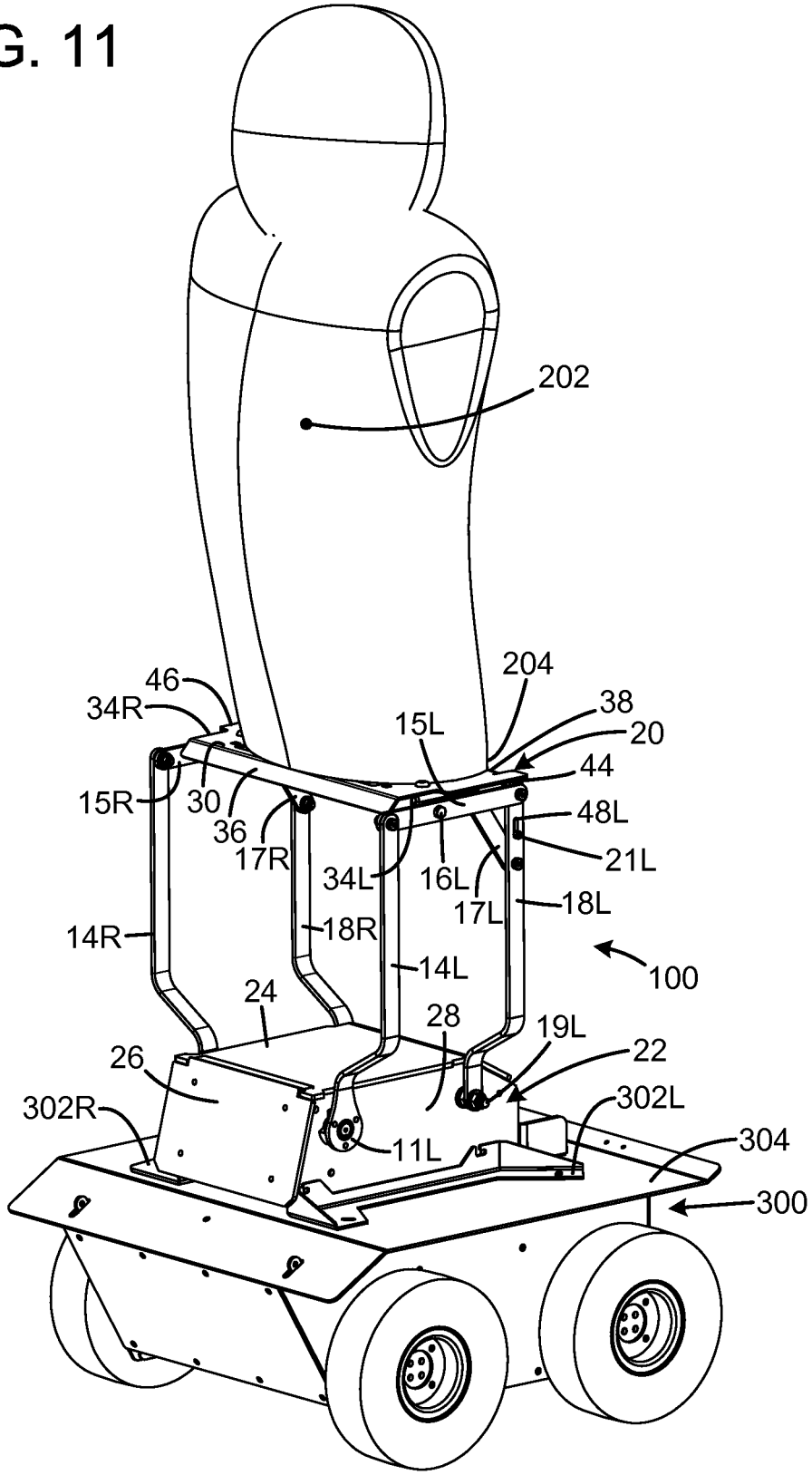
FIG. 11 is a top perspective view with the weaponry target mechanism of FIG. 8 mounted on a moving platform.
Figure 12:
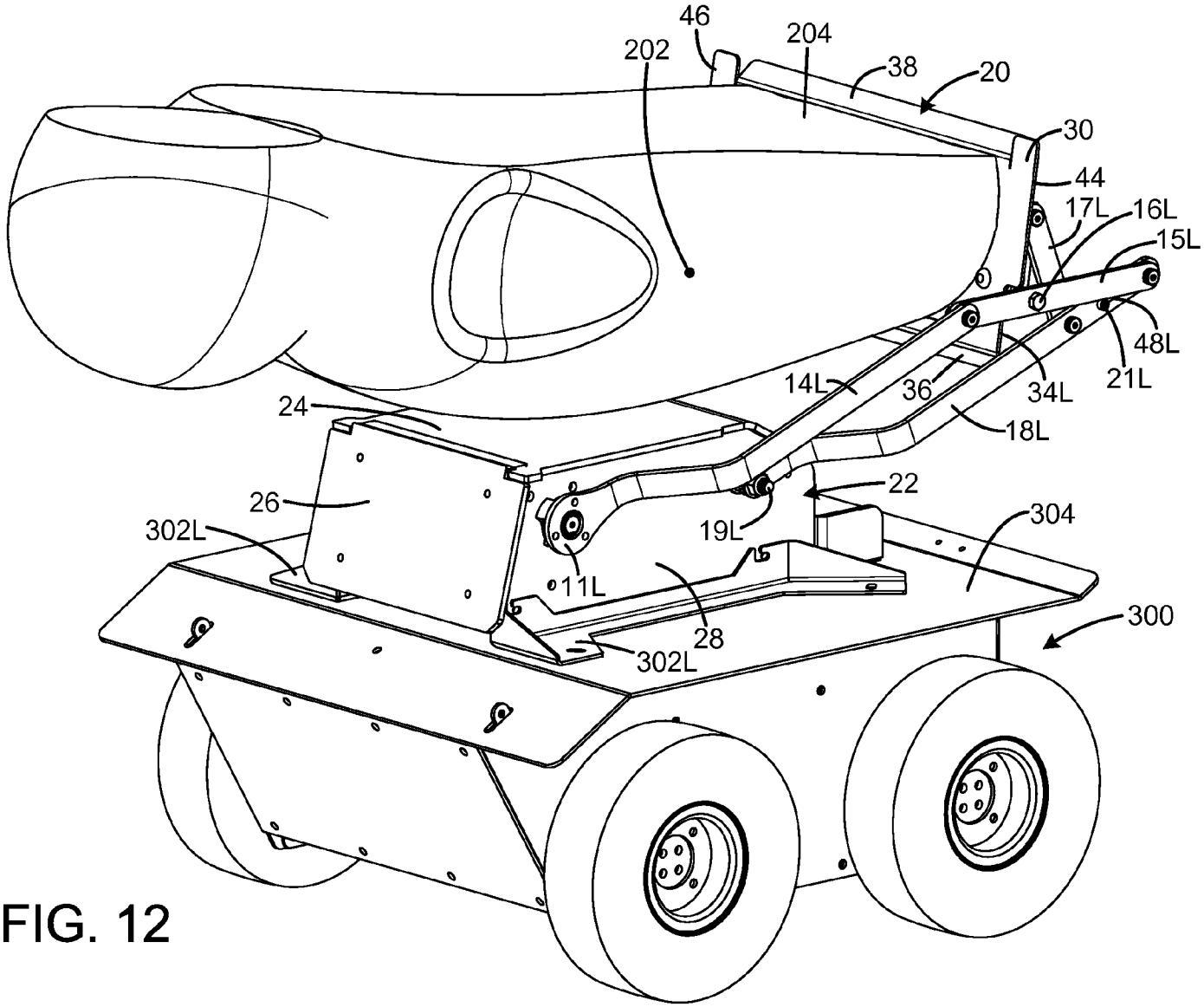
FIG. 12 is a top perspective view of the weaponry target mechanism of FIG. 11 in the dropped position.

FIGS. 11-12 illustrate the improved weaponry target mechanism 100 of the present invention. More particularly, the mechanism is shown mounted on a moving platform 300. The mechanism is depicted with a target mannequin 200 attached to the target mounting plate 20 at the approximate location of the mannequin's waistline 204. FIG. 11 shows the mannequin in the standing or "alive" condition. FIG. 12 shows the mannequin attached to the target mounting plate in the collapsed or "killed" position. The mannequin has a center of mass 158. The mechanism is releasably secured to the top 304 of the moving platform by mounting brackets 302R, 302L.

As is shown in FIGS. 7, 10, and 12, when a mannequin 150, 200, or other suitable weapons target is attached to the target mounting plate 20, the net motion effect of the mounting plate when the mannequin is hit is to lower the mannequin while simultaneously pitching the mannequin forward. Shifts in the center of mass 158, 202 are reduced or eliminated (the center of mass of the target remains within a vertical plane that is perpendicular to the housing in both the upright and dropped positions), and the total space required to operate the device is minimized because of the forward motion of the mannequin. The feedback sensor 12 provides accurate position information to the control electronics 52, which enables the control electronics to operate the actuator 10 to precisely control the speed and position of the mannequin by controlling the rotation direction and speed of the shaft.

FIGS. 13-21 illustrate an improved weaponry target mechanism 400 of the present invention. More particularly, the mechanism is shown with a target mannequin 200 attached to a target mounting platform or bracket 420 at the approximate location of the mannequin's waistline 204. FIGS. 13-17 show the mannequin in the standing or "alive" condition. FIGS. 18-21 show the mannequin attached to the target mounting platform or bracket in the collapsed or "killed" position. The mannequin has a center of mass 202.

Figure 13:
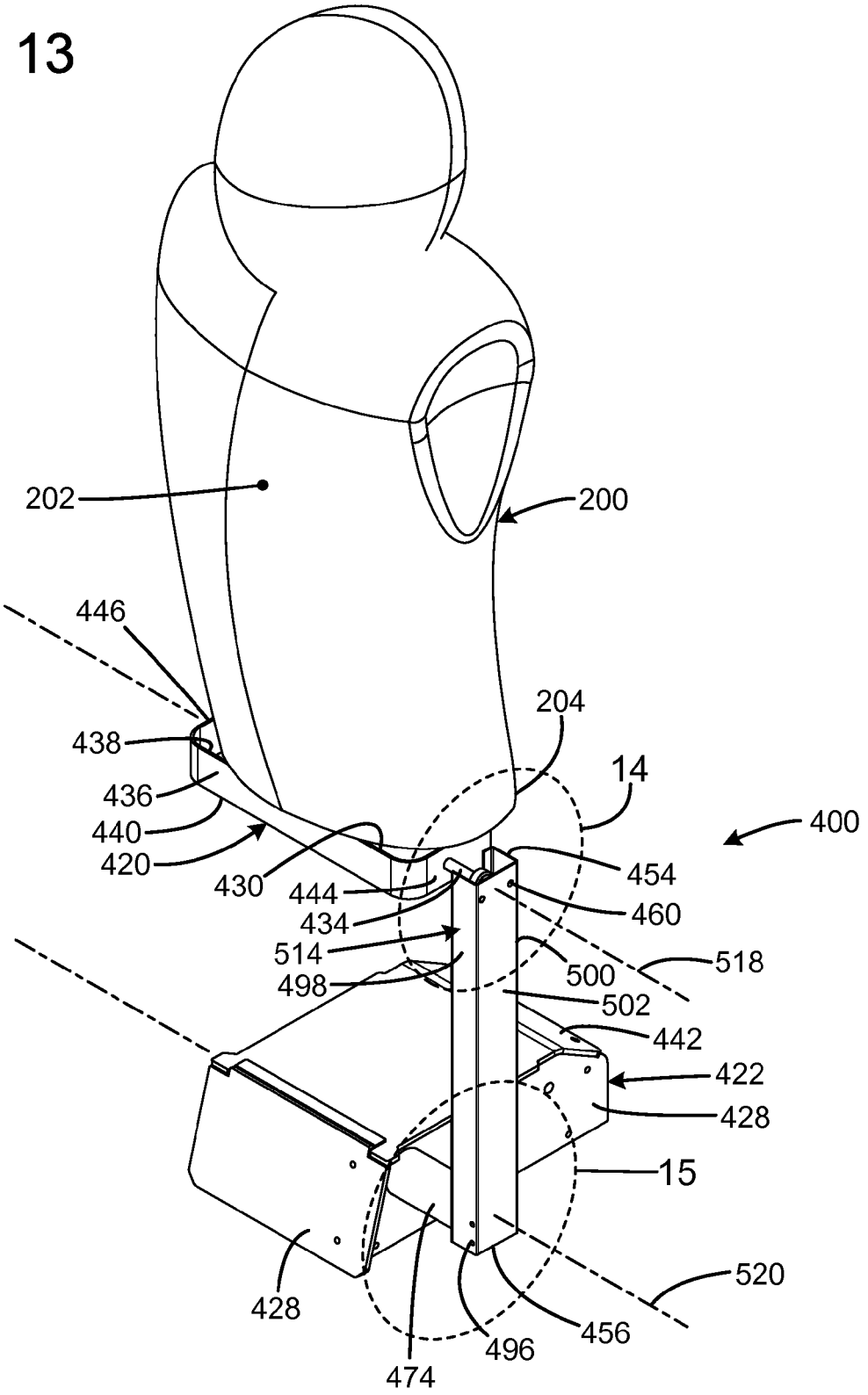
FIG. 13 is a top isometric view of an alternative embodiment of a weaponry target mechanism constructed in accordance with the principles of the present invention in the upright position.

Referring now to FIG. 13, the upper portion of the mechanism 400 has a generally U-shaped target mounting platform or bracket 420 with a front 436, rear 438, left arm 444, right arm 446, top 430, and bottom 440. The left arm of the mounting bracket is pivotally connected to the top 454 of an arm tube 514 by an upper shaft 434. The bottom 456 of the arm tube is connected to a housing 22. The arm tube also has an interior 458, which defines an arm passage, and a left side 502.

Figure 14:
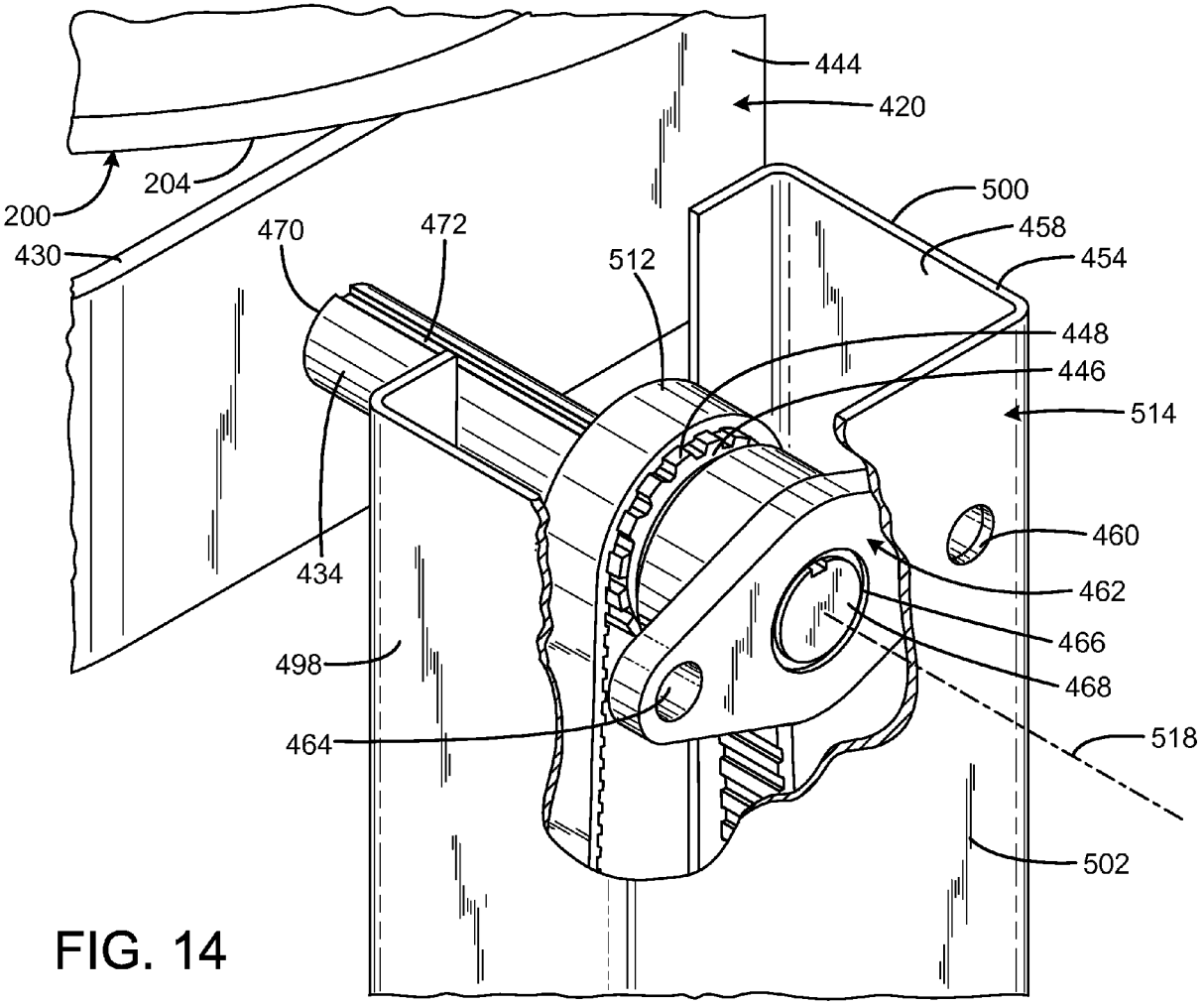
FIG. 14 is an enlarged view taken along circle 14 of FIG. 13.

As is shown in FIG. 14, one end 470 of the upper shaft is attached to the left arm 444 of the target mounting bracket 420, and the opposed end 468 of the upper shaft is received within a central bore 466 in a shaft bearing 462. The longitudinal axis of the upper shaft defines a target axis 518. The shaft bearing has bolt holes 464 that are axially registered with bolt holes 460 in the left side 502 of the arm tube 514 and is secured to the arm tube by bolts (not shown). A portion of the upper shaft adjacent to the shaft bearing defines a timing wheel or pulley 446 with teeth 448. A tension member in the form of a timing belt 512 is wrapped about the periphery of the timing pulley such that movement of the timing belt induces rotation of the upper shaft. Any suitable flexible tension member can be used instead of the timing belt, including a cable, a cord, or a chain. The timing belt is part of a drive mechanism that is contained within the arm passage defined by the interior 458 of the arm tube. The arm tube may be optionally covered by strips of armor plate to provide enhanced ballistic protection for the enclosed drive mechanism.

Figure 15:
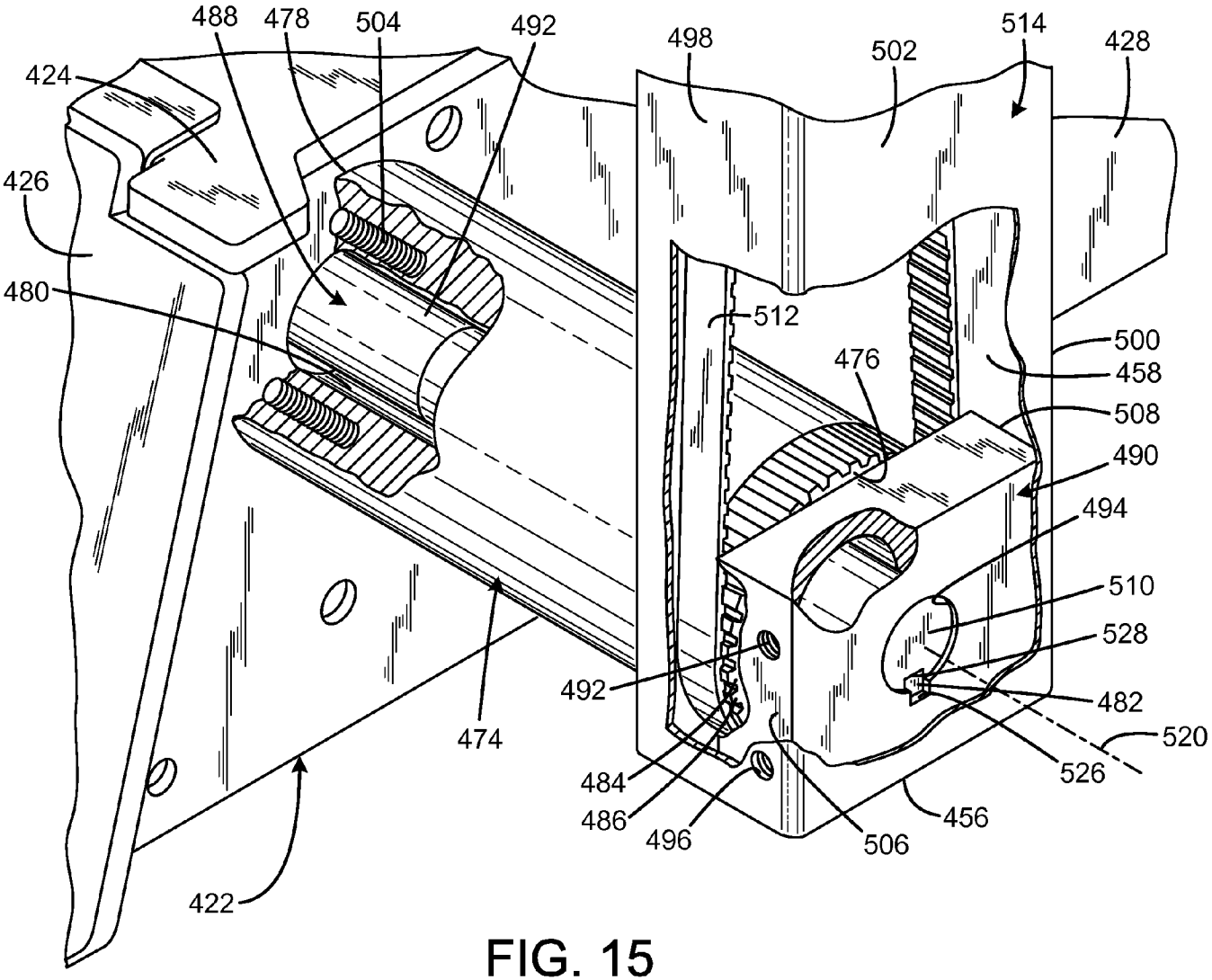
FIG. 15 is an enlarged view taken along circle 15 of FIG. 13.

As is shown in FIG. 15, one end 478 of a pulley boss 474 is attached to the left cover 428 of a housing 422 by bolts (not shown) engaging bolt holes 504 in the pulley boss. The housing also has a right cover (not visible), a top cover 424, a front cover 426, and a rear cover 442. The housing serves as a base for the mechanism 100.

The pulley boss 474 includes a central bore 480 and defines a timing wheel or pulley 484 with teeth 486 at an opposed end 476. The timing belt 512 is wrapped about the periphery of the timing pulley on the pulley boss, but the pulley boss cannot rotate with respect to the housing 422 because the pulley boss is bolted to the left cover 428.

One end 510 of a motor shaft 488 passes through the central bore 480 in the pulley boss 474 and through a bore 494 in an arm tube mounting block 490. The motor shaft does not contact the pulley boss. The longitudinal axis of the motor shaft defines a lower arm axis 520. The exterior 492 of the motor shaft defines a notch 528, and the bottom of the bore 494 in the arm tube defines a notch 526 aligned with the notch 528. A shaft key 482 is received within the notches 526, 528 to attach the arm tube mounting block to the motor shaft. One end 532 of a set screw 530 passes through an aperture 534 in the arm tube mounting block to retain the shaft key within the notches 526, 528. As a result, the arm tube mounting block is induced to rotate by the motor shaft.

The arm tube mounting block 490 has a front 506 and rear 508. The arm tube mounting block has four bolt holes 492 (two in the front and two in the rear) that are axially registered with four bolt holes 496 in the arm tube 514 (two in the front and two in the rear). Bolts (not shown) are inserted through the bolt holes to attach the arm tube mounting block to the arm tube. As a result, the arm tube is induced to rotate with the arm tube mounting block by the motor shaft 488.

Figure 16:
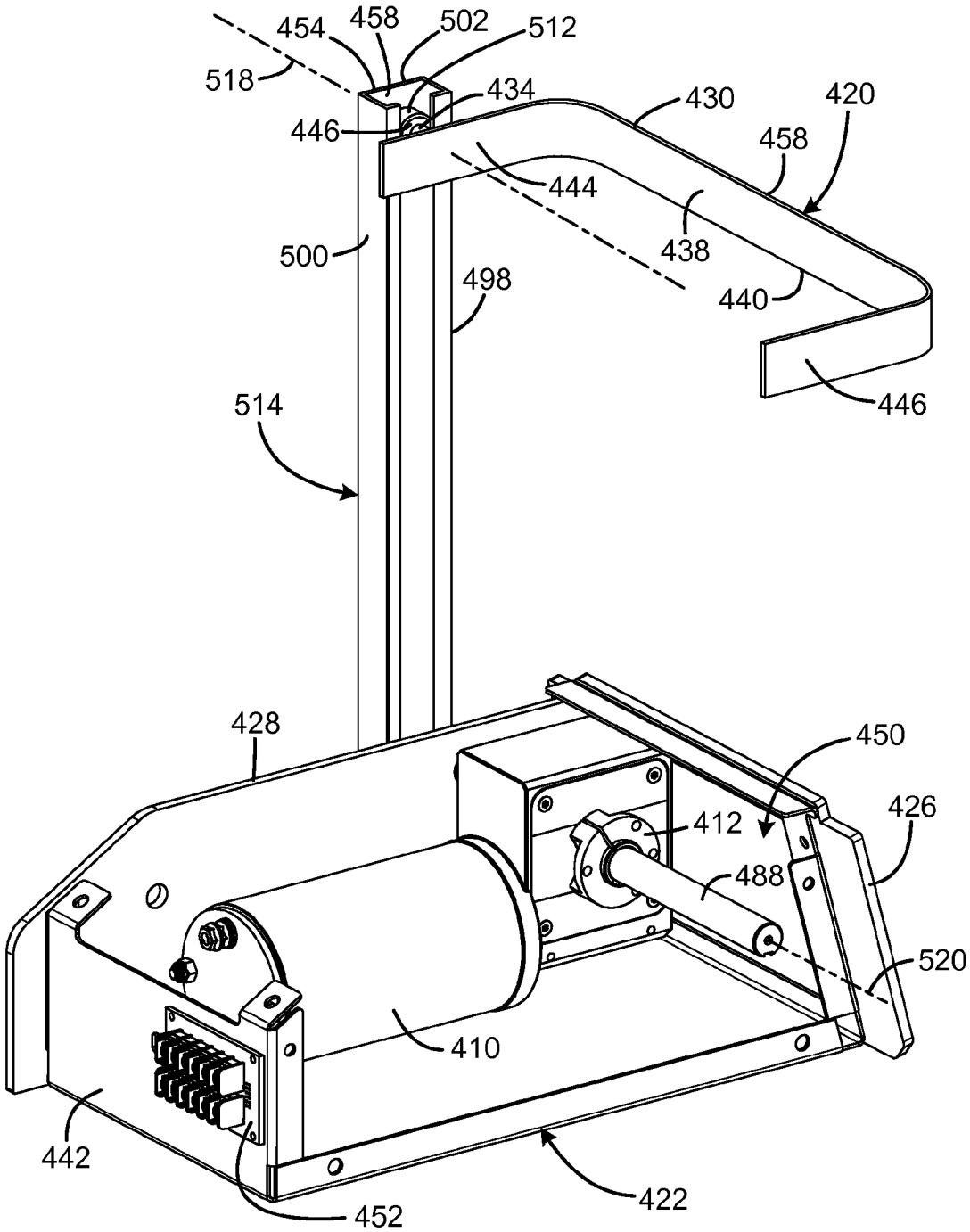
FIG. 16 is a top perspective view of the weaponry target mechanism of FIG. 13 with various components removed to expose the interior of the housing.

FIG. 16 illustrates the improved weaponry target mechanism 400 of the present invention. More particularly, the mechanism is shown with the top cover 424 and the right cover 444 and associated parts removed to expose the interior 450 of the housing 22.

The interior 450 of the housing 422 receives an actuator 410 that drives the motor shaft 488 via a gearbox 516. A position feedback sensor 412 mounted on the motor shaft provides accurate position information to control electronics 452 mounted on the rear cover 442.

Figure 17:
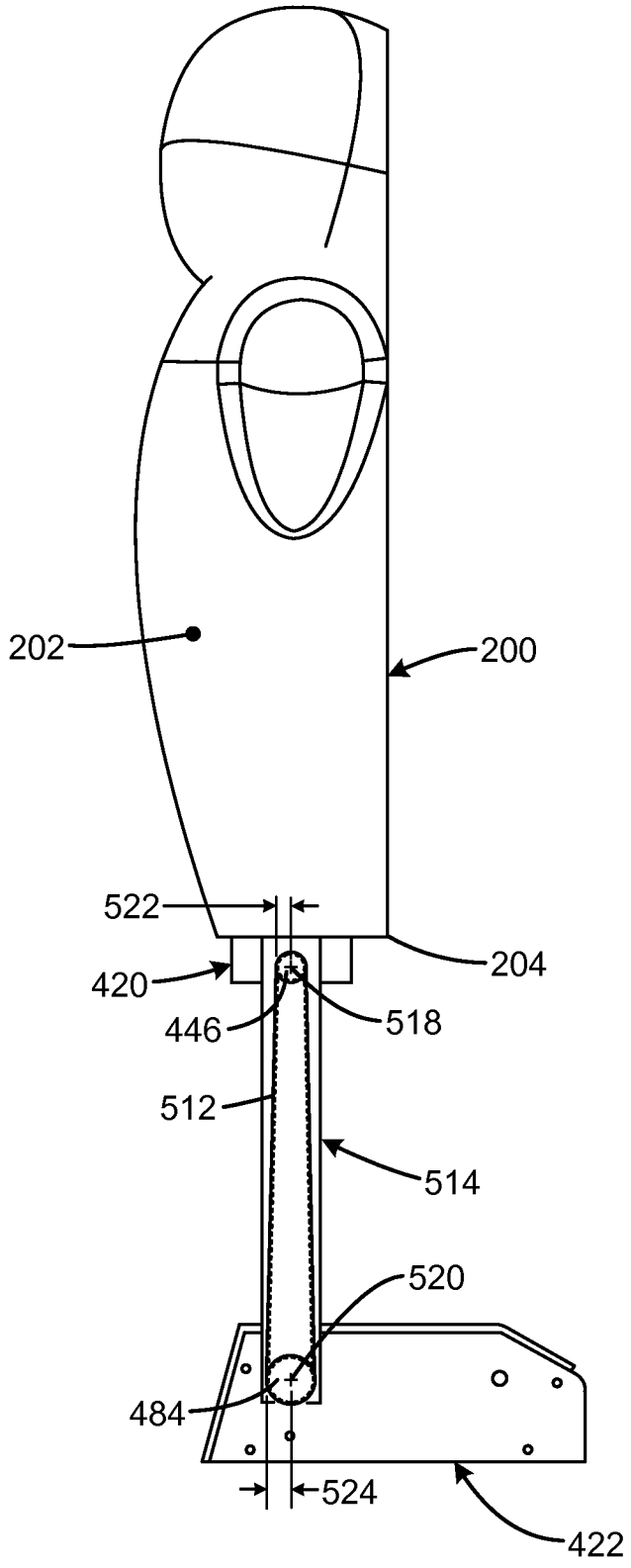
FIG. 17 is a left side sectional view of the weaponry target mechanism of FIG. 13 in the upright position.
Figure 18:
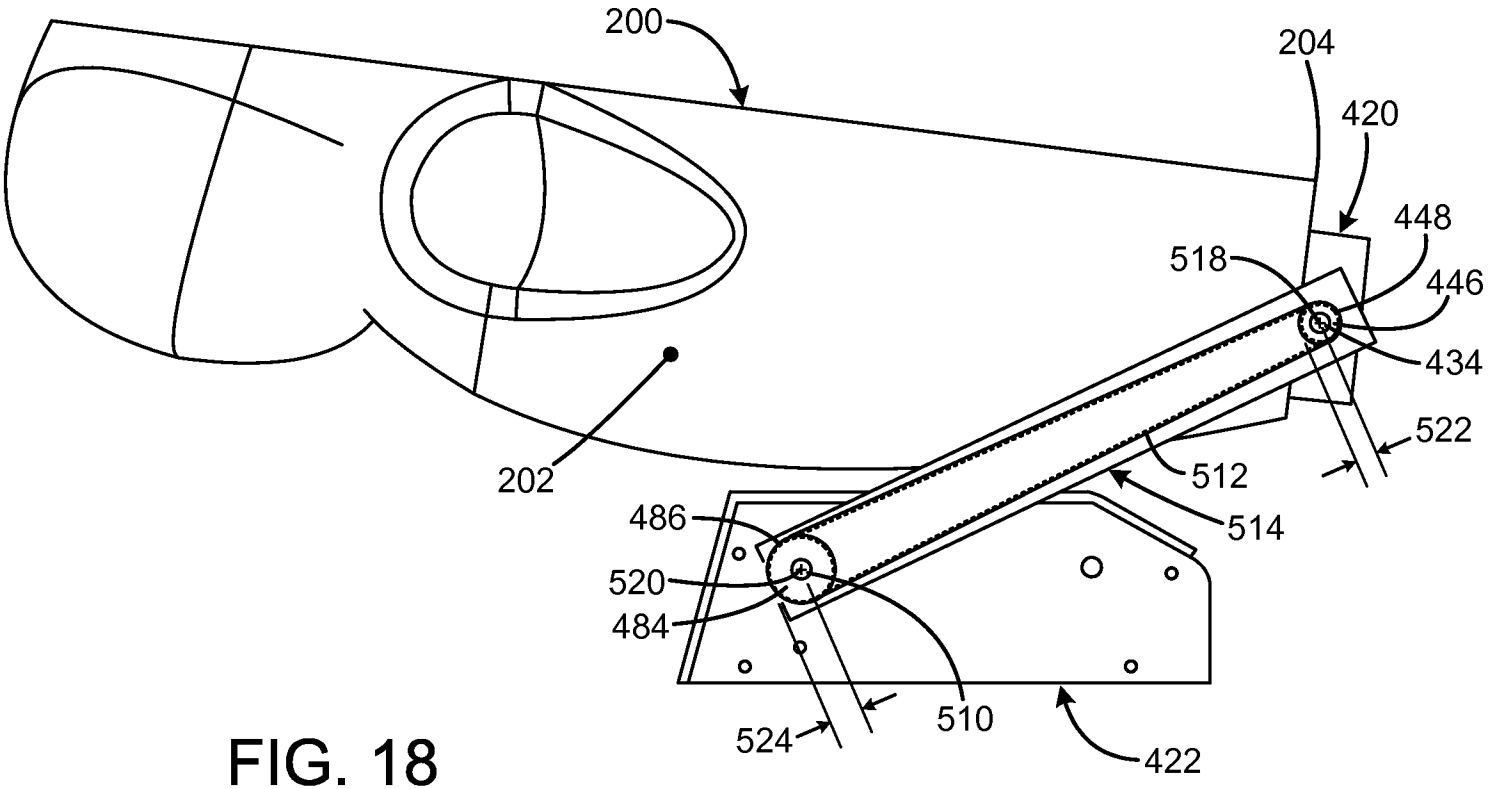
FIG. 18 is a left side sectional view of the weaponry target mechanism of FIG. 13 in the dropped position.
Figure 19:
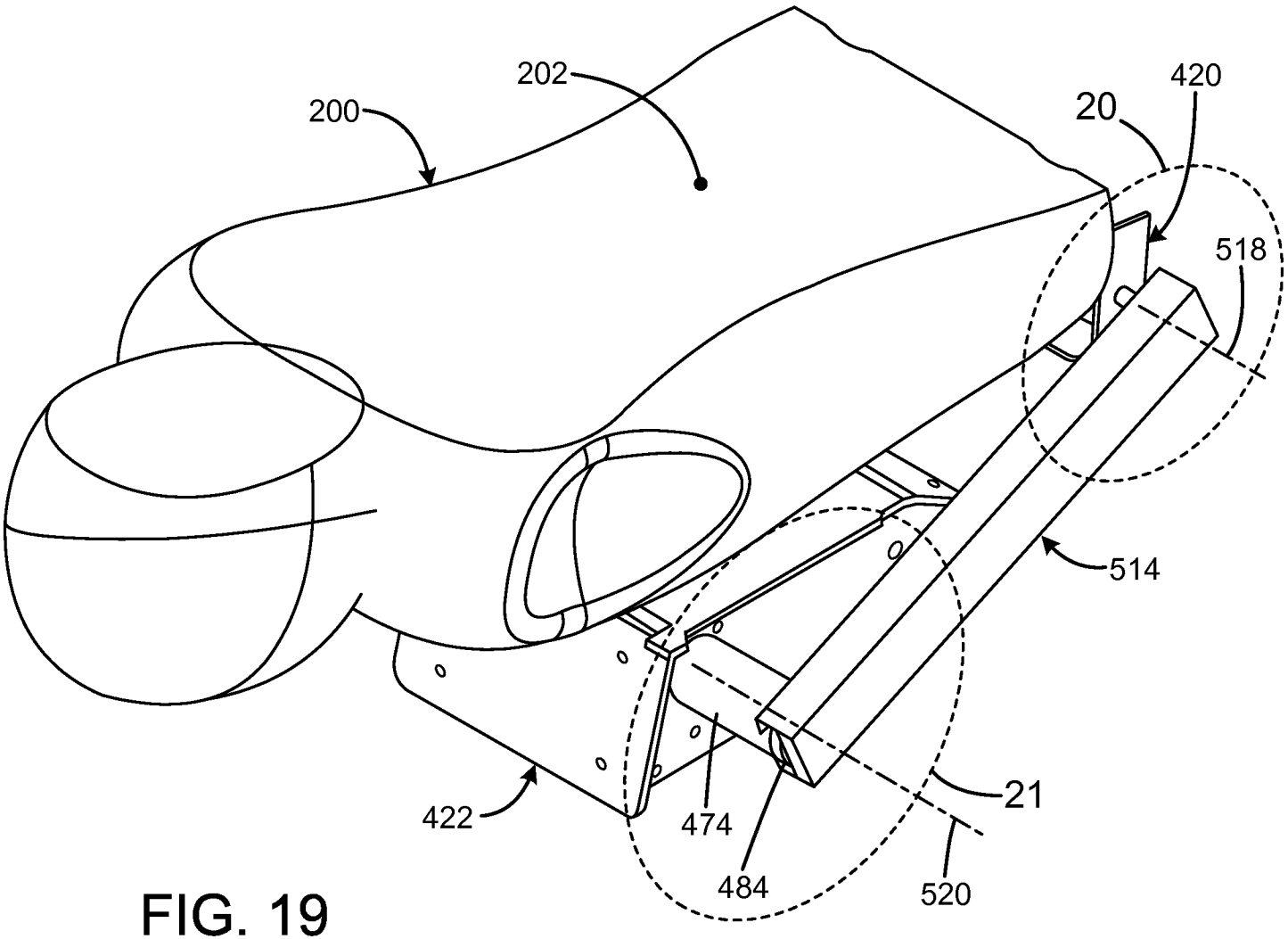
FIG. 19 is a top isometric view of the weaponry target mechanism of FIG. 13 in the dropped position.
Figure 20:
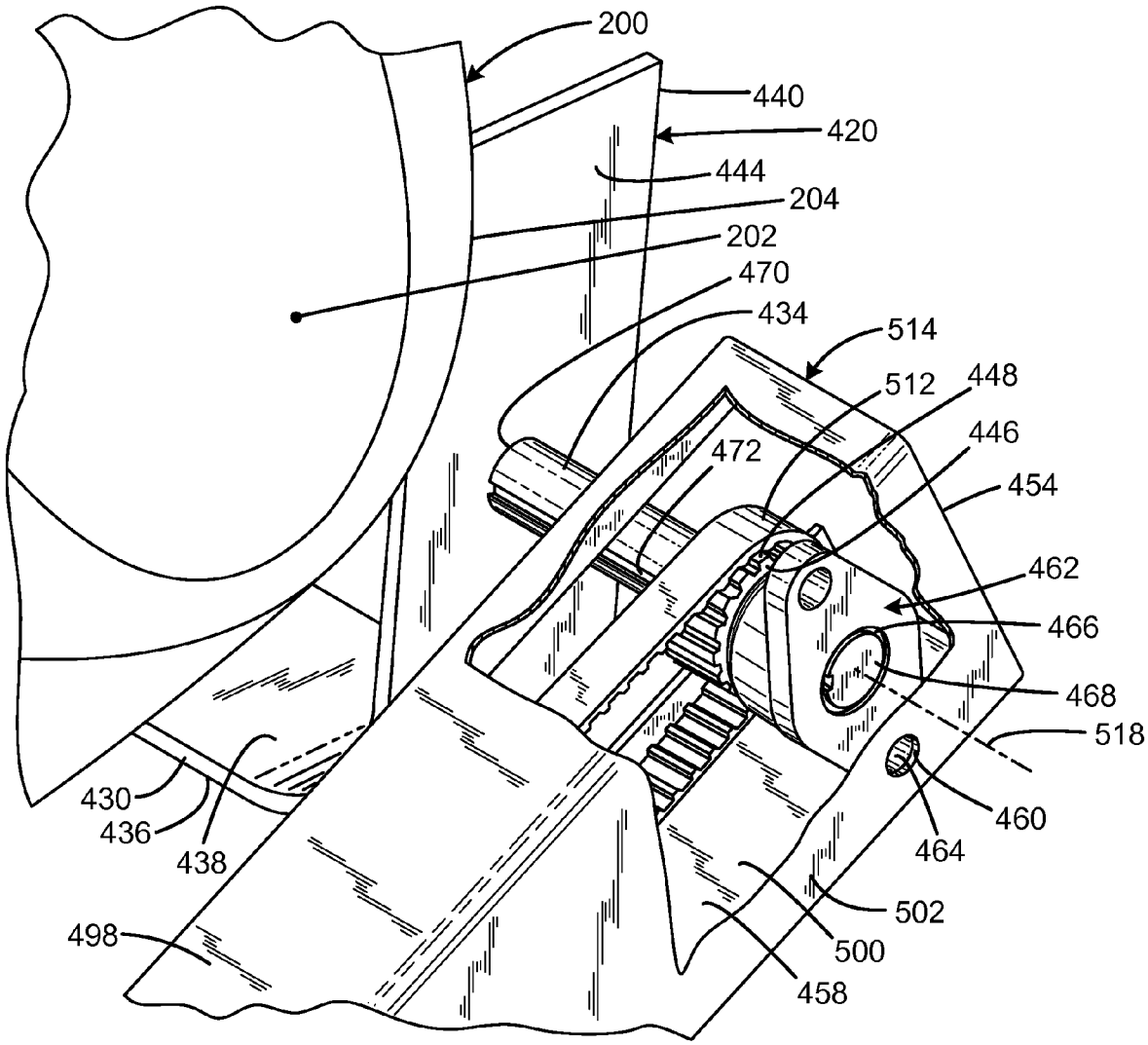
FIG. 20 is an enlarged view taken along circle 20 of FIG. 15.
Figure 21:
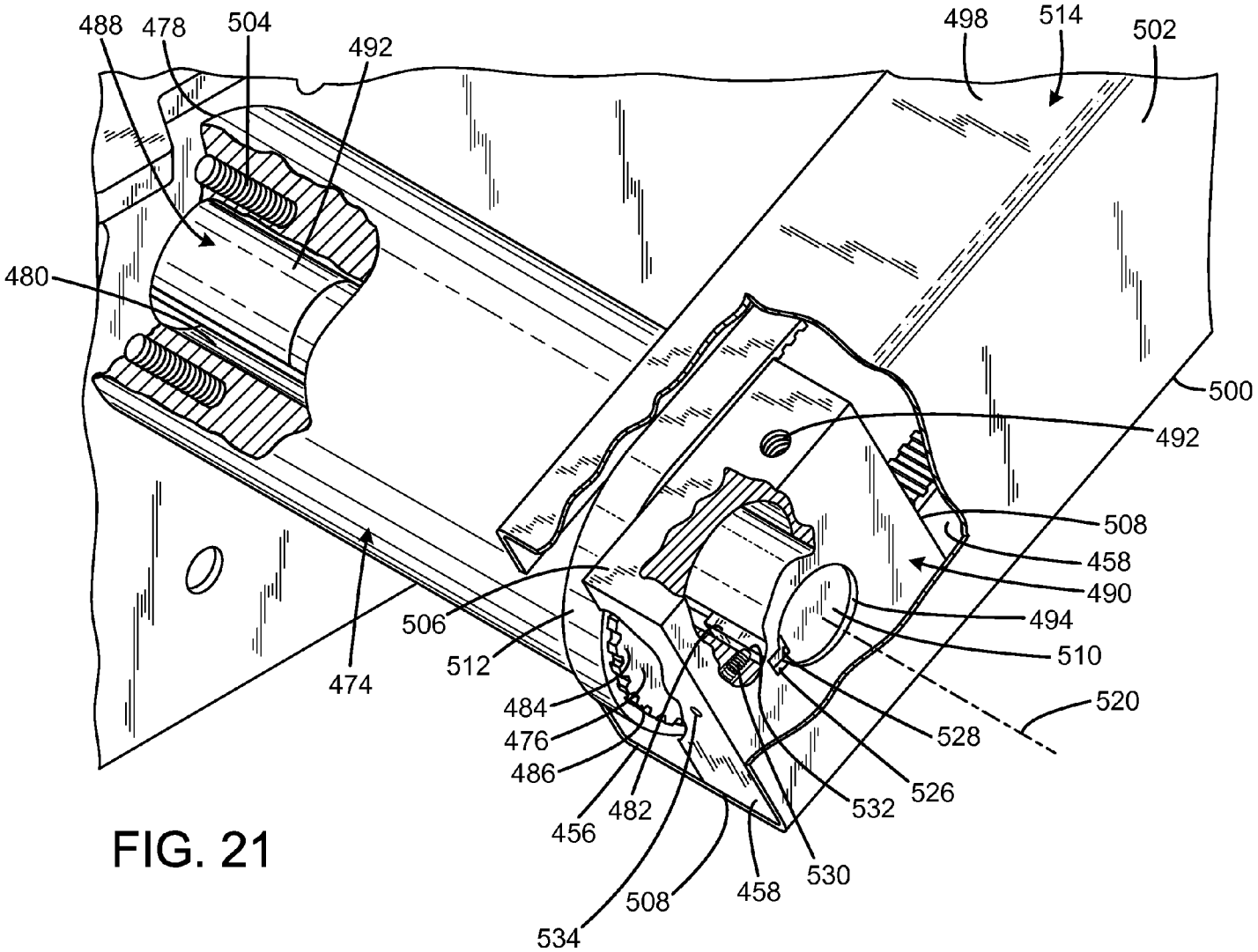
FIG. 21 is an enlarged view taken along circle 21 of FIG. 15.

FIGS. 17 and 18 illustrate the improved drive mechanism of the present invention. More particularly, the drive mechanism includes the timing pulleys 446, 484 and the timing belt 512. The timing pulleys 446, 484 have different radiuses, with timing pulley 446 being smaller than timing pulley 484. Because the pulleys have different radiuses, the first connection location of the timing belt 512 portion of the drive mechanism is spaced apart from the lower arm axis 520 by a first radius 524, and the second connection location of the timing belt portion of the drive mechanism is spaced apart from the target axis 518 by a second radius 522 that is different from the first radius.

By comparing FIGS. 18-21, which show the weaponry target mechanism 400 in the dropped position, with FIGS. 13-17, which show the weaponry target mechanism 400 in the upright position, the motion of the mechanism can be appreciated. Specifically, rotational motion of the motor shaft 488 causes the arm tube 514 to rotate about the motor shaft's longitudinal axis that defines lower arm axis 520 because of the connection between the arm tube and the arm tube mounting block 490, and the connection between the arm tube mounting block and the end 510 of the motor shaft. The upper shaft 434 rotates in a direction opposite that of the motor shaft because the upper shaft is driven by the timing belt 512 and timing pulleys 446, 484. The movement of the arm tube resembles that of a planetary gear.

As a result, when a mannequin 200 or other suitable weapons target is attached to the target mounting bracket 420, the net motion effect of the mounting bracket when the mannequin is hit is to lower the mannequin while simultaneously pitching the mannequin forward. Shifts in the mannequin's center of mass 202 are reduced or eliminated (the center of mass of the target remains within a vertical plane that is perpendicular to the housing 422 in both the upright and dropped positions), and the total space required to operate the device is minimized because of the forward motion of the mannequin. The feedback sensor 412 provides accurate position information to the control electronics 452, which enables the control electronics to operate the actuator 410 to precisely control the speed and position of the mannequin by controlling the rotation direction and speed of the motor shaft 488.

While current embodiments of a weaponry target mechanism have been described in detail, it should be apparent that modifications and variations thereto are possible, all of which fall within the true spirit and scope of the invention. For example, although mannequin-style targets have been described, the mechanism is suitable for use with any type of weapons target. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A weaponry target mechanism comprising:

a base;

an arm pivotally connected to the base to pivot about a lower arm axis;

a platform pivotally connected to the arm to pivot about a target axis;

an elongated target attached to the platform;

a drive mechanism connected to the base at a first connection location spaced apart from the lower arm axis;

the drive mechanism connected to the platform at a second connection location spaced apart from the target axis;

wherein the platform is movable with respect to the base such that the target assumes an upright position in which the target is in a first pivotal orientation and a dropped position in which the target is in a second pivotal orientation pivotally offset from the first pivotal orientation; and wherein the platform is rotationally moveable with respect to the base such that the platform is parallel to the base in the upright position and the platform is not parallel to the base in the dropped position and wherein the drive mechanism includes a first wheel attached to the base and wherein the drive mechanism includes a flexible tension member engaged to a periphery of the wheel.

2. The mechanism of claim 1 including a second wheel attached to the platform.

3. The mechanism of claim 2 wherein the first wheel and second wheel have different radiuses.

4. The mechanism of claim 1 wherein the tension member is wrapped about the wheel.

5. The mechanism of claim 1 wherein the first wheel is fixed to the base.

6. The mechanism of claim 1 wherein the tension member is selected from a group comprising a cable, a cord, a chain, and a belt.

7. The mechanism of claim 1 wherein the first connection location is spaced apart from the lower arm axis by a first radius, and the second connection location spaced is apart from the target axis by a second radius different from the first radius.

8. A weaponry target mechanism comprising: a base;

an arm pivotally connected to the base to pivot about a lower arm axis;

a platform pivotally connected to the arm to pivot about a target axis;

an elongated target attached to the platform; a drive mechanism connected to the base at a first connection location spaced apart from the lower arm axis;

the drive mechanism connected to the platform at a second connection location spaced apart from the target axis;

wherein the platform is movable with respect to the base such that the target assumes an upright position in which the target is in a first pivotal orientation and a dropped position in which the target is in a second pivotal orientation pivotally offset from the first pivotal orientation;

and wherein the platform is rotationally moveable with respect to the base such that the platform is parallel to the base in the upright position and the platform is not parallel to the base in the dropped position;

and wherein the arm defines an arm passage, and the drive mechanism is contained within the arm passage.

* * * * *